US005791799A

United States Patent [19]

Oehlhorn

[11] Patent Number: 5,791,799

[45] Date of Patent: Aug. 11, 1998

[54] LIPSTIC WITH RETARDANT DEVICE

[75] Inventor: Gerald Oehlhorn, Bamberg, Germany

[73] Assignee: Oekametall Oehlhorn GmbH & Co., KG, Bamberg, Germany

[21] Appl. No.: 795,011

[22] Filed: Feb. 5, 1997

Related U.S. Application Data

[63] Continuation of Ser. No. 524,015, Sep. 5, 1995, abandoned.

[30] Foreign Application Priority Data

Sep. 9, 1994 [DE] Germany ..... 44 32 108.2

[51] Int. Cl.[6] ..... B43K 21/08; B43K 21/00

[52] U.S. Cl. ..... 401/78; 401/74; 401/80

[58] Field of Search ..... 401/78, 77, 76, 401/74, 68, 55, 80

[56] References Cited

U.S. PATENT DOCUMENTS

| | | | |
|---|---|---|---|
| 3,515,493 | 6/1970 | Gruska | 401/78 X |
| 3,706,500 | 12/1972 | Gruska | 401/78 |
| 5,324,126 | 6/1994 | Holloway et al. | 401/78 |

FOREIGN PATENT DOCUMENTS

| | | | |
|---|---|---|---|
| 2016387 | 12/1973 | Germany | 401/78 |
| 1118889 | 7/1968 | United Kingdom | 401/78 |
| 8603658 | 7/1986 | WIPO | 401/78 |

*Primary Examiner*—Robert A. Hafer
*Assistant Examiner*—D. Neal Muir
*Attorney, Agent, or Firm*—Anderson Hill & Olick, P.C.

[57] ABSTRACT

A lipstick including a twist sleeve, which is mounted on a slotted tube and has a lower end edge resting on an annular ledge of the slotted tube, and a retardant ring formed integrally with the twist sleeve and arranged in a free space formed between the annular ledge of the slotted tube and the lower end of the twist sleeve.

1 Claim, 1 Drawing Sheet

LIPSTIC WITH RETARDANT DEVICE

RELATED APPLICATIONS

This is a continuation of application Ser. No. 08/524,015, filed Sep. 5, 1995, now abandoned.

BACKGROUND OF THE INVENTION

The invention relates to a lipstick, in which a twist sleeve of a plastic material is disposed on a slotted tube of a plastic material between an abutment bead and an annular ledge of the slotted tube and has an end edge resting on the annular ledge the slotted tube. The twist sleeve and the slotted tube cooperate with a radially prestressed single-piece retarding device.

In a lipstick of this type known from the DE-PS 34 25 591, the twist sleeve abuts the annular ledge an end edge which coincides with an external circumference of the twist sleeve. It is generally known to provide a retardant device for this type of lipstick, in which the slotted tube has two knobs axially offset relative to the ledge, and the twist sleeve has bottom end strips which abut the knobs under a radial prestress. The knobs are arranged to be diametrically opposite to each other, and the slotted tube has a slightly oval cross section whereby the slotted tube is subjected to radial stress. When the twist sleeve together with the retardant device is turned manually relatively to the slotted tube, then one notices that the rotational motion is not sufficiently uniform, smooth or free of jolts. This disadvantage becomes more noticeable when the twist sleeve is covered externally by a metal sleeve, which tends to assume an outer oval cross section.

Accordingly, an object of the invention is a lipstick of above-mentioned type in which the retardant device acts in a more uniform, smooth or jolt-free manner than was the case previously.

SUMMARY OF THE INVENTION

This and other objects of the invention, which will become apparent hereinafter, are achieved by providing an annular ledge which is set back radially with its end edge relative to the external circumference of the twist sleeve, thus forming a free space across the circumference, by forming the twist sleeve integrally with a retardant ring having a thinner wall thickness and arranged in the free space between the annular ledge and the end of the twist sleeve with a radial prestress. At that, the outer surface of the annular ledge is cone-shaped, and the retardant ring rests with its end region on the annular ledge outer surface.

The annular retardant ring rests uniformly on the annular ledge, and a uniform, smooth and jolt-free retardation of the rotation of the twist sleeve relative to the slotted tube is established. The retardant ring forms a single piece with the twist sleeve, which simplifies the manufacture and the assembly of the lipstick. The retardant ring firmly engages the annular ledge of the slotted tube in order to provide the desired friction. The retardant ring can be slightly expanded in radial direction and has a reduced wall thickness in comparison with the twist sleeve in radial direction, in order to have the desired expandability. The twist sleeve still has its axial end edge resting on the annular ledge, with the free end edge of the retardant ring being free from an axial load. An axial contact of the retardant ring would have impaired the desired uniform, smooth and jolts-free retardant operation. The retardant ring, which is formed as one-piece with the twist sleeve engages the annular ledge of the slotted tube.

Due to the conical shape of the annular ledge outer surface, the retardant ring does not rests with a large surface on the annular ledge and in an uncontrollable way, rather it contacts the annular ledge only with a relatively small surface. In this way, the radial contact pressure between the retardant ring and the annular ledge can be easily adjusted and controlled.

In a particularly desirable and advantageous embodiment of the invention, the retardant ring is annular. The annular closed retardant ring can radially expand to the required slight amount, since its wall thickness is small, and the plastic material is somewhat elastically expandable. In combination with a cone shape of the annular ledge, the annular continuous retardant ring is somewhat lengthen in circumferential direction so as to produce a radial prestress which causes the retardation in the desired manner. As a rule, it is sufficient if the wall thickness of the retardant ring tapers radially inside relative to the twist sleeve and if it is radially flushed externally with the twist sleeve.

It is however, also appropriately advantageous, if the retardant ring is actually slotted and is divided into individual retardant tabs. This also provides the desired radial expansion of the retardant ring along its entire circumference.

It is particularly appropriate and advantageous herein, if at least five slots are provided to be equally distributed across the circumference of the retardant ring. In case of a fewer slots the retardant arrangement tends to jam.

As a rule, the width of the slots in circumferential direction amounts to 1 millimeter at the maximum. If the slots are wider, then in case the lipstick has not been used for a while, some material of the annular ledge enters into the slots, then during initial turning or twisting at the start, a jolt occurs in the course of the subsequent turning resulting in roughness during the rotational motion.

It is therefore particularly desirable and advantageous if the two, slot-limiting internal edges are rounded in radial direction in every slot. The retardant tabs thus do not form sharp corner edges or burrs at the slots, which could result in tilting of the annular ledge.

As a rule the thickness of the retardant tabs tapers on both sides in radial direction relative to the twist sleeve. The reduction of the thickness of the retarding tabs on both sides simplifies the shaping process required in fabrication.

BRIEF DESCRIPTION OF THE DRAWINGS

The features and objects of the present invention will become more apparent, and the invention itself will be best understood from the following detailed description of the preferred embodiments when read with reference to the accompanying drawings, wherein.

DETAILED DESCRIPTION OF THE PREFERRED EMBODIMENTS

Figure 1:
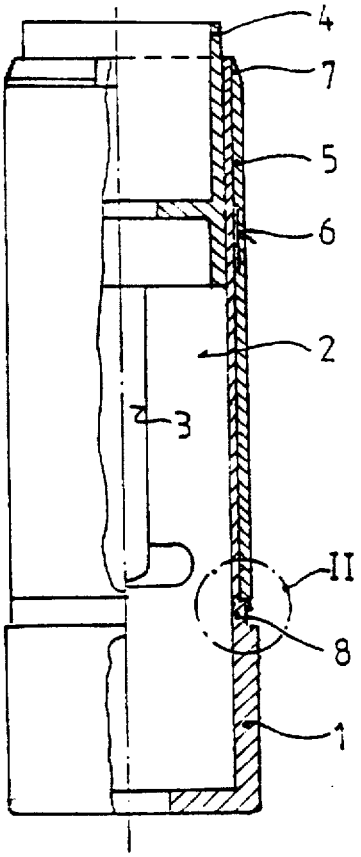
FIG. 1 shows a side, partially cross-sectional view of a first embodiment of a lipstick with a retardant device according to the present invention.

A lipstick according to the present invention, which is shown in FIG. 1, includes a base member 1 which carries a projecting upwards, formed integrally therewith, slotted tube 2 provided with an elongate slot 3 at each of its two opposite sides. The slotted tube 2 receives a substance bawl 4 which can be displaced up and down, and into which the lipstick peg (not shown) is inserted. The substance bawl 4 carries radially protruding pins (not shown) which project through respective ones of the slots 3. A twist sleeve 5 is mounted on the slotted tube 2 so as to be rotatable and has two helical grooves 6 on the internal side, into which grooves 6 the radial pins of the substance bawl 4 engage. The lipstick is completed by a closing cap (not shown) which is slid from the top over the twist sleeve 5 when the substance ball is retracted, and a metal sleeve (not shown) is mounted on the exterior of the twist sleeve.

Figure 2:
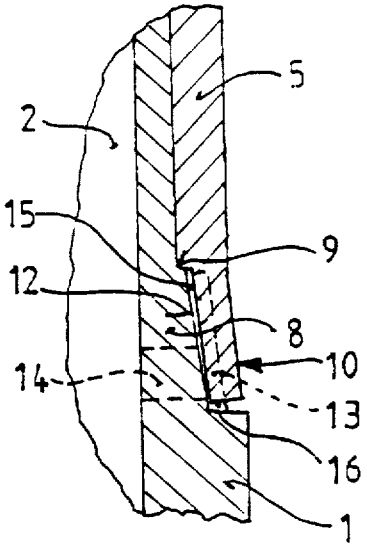
FIG. 2 shows a detail II of the lipstick shown in FIG. 1 at an increased scale.

The slotted tube 2 comprises an abutment bead 7 protruding radially outward, which bypasses the slots 3. The slotted tube 2 has also at its bottom an annular closed ledge 8 which surrounds the base member and is not connected with the slots 3. As shown in FIG. 2, the twist sleeve 5 has at its lower end an edge 9 which is supported on the annular ledge 8 and protrudes radially outwardly beyond same to a considerable extent. A retardant ring 10 projects downwardly from the edge 9. The annular ledge 8 has an outer surface 12 which widens downward in a cone shaped manner. The retardant ring 10 has an end region 13 with which it rests against an annular strip 14 of the annular ledge 8, which is indicated by a dotted line. The remaining portion of the retardant ring 10 is spaced by a clearance 15 from the outer surface 12 of the ledge 8. The free end of the retardant ring 10 is separated by an air gap 16 from the step formed by the radially protruding base member 1.

Figure 4:
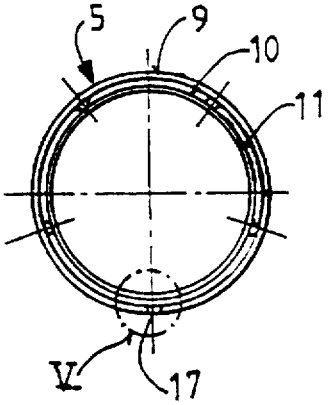
FIG. 4 shows a bottom view of a twist sleeve of the lipstick in FIG. 3, and FIG. 5 a detailed V of the lipstick showing in FIG. 4 at an increased scale.
Figure 3:
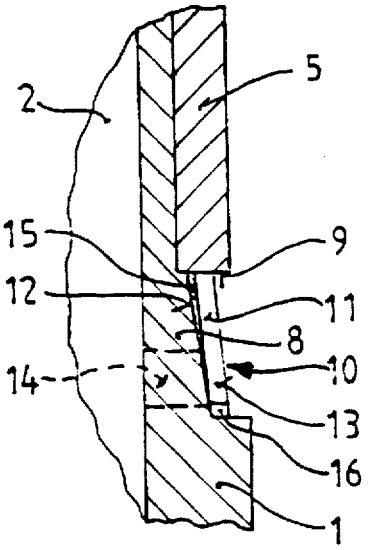
FIG. 3 shows a partial cross-sectional view corresponding to the view shown in FIG. 2 of a second embodiment of a lipstick with a retardant device according to the present invention.
Figure 5:
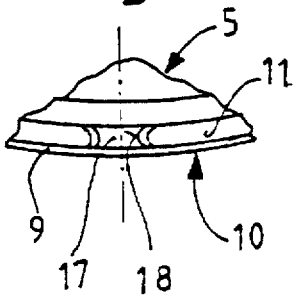

As shown in FIGS. 1 and 2, the retardant ring 10 is circumferentially closed and has its thickness reduced radially inwardly by a recess. As shown in FIGS. 3, 4 and 5 the retardant ring 10 is formed of axial retarding tabs 11. The retarding tabs 11 are bent radially outward towards their free ends. Each two retarding tabs 11 enclose a slot 17 between them, and each slot 17 limited is by two rounded inner edges 18, as shown in FIG. 5. The retardant ring 10 has at least five slots 17.

Though the present invention was shown and described with reference to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A lipstick, comprising:

a slotted tube for receiving a substance bawl, the slotted tube having, at a lower end thereof, a ledge having an axially extending conical outer surface;

a twist sleeve formed of a plastic material and mounted on the slotted tube, the twist sleeve having, at a lower end thereof, an edge resting on the ledge of the slotted tube, and the ledge and the lower end of the twist sleeve defining a free space there between; and a retardant ring formed as a closed annular ring and arranged in the free space between the ledge and the lower and of the twist sleeve, the retardant ring being formed integrally with the twist sleeve and having a wall thickness, along an entire circumference thereof, smaller than a wall thickness of the twist sleeve, the retardant ring having a relatively narrow end region abutting the conical outer surface of the ledge along an entire circumference of the ledge, whereby a radial prestress is provided along an entire circumference of the retardant ring due to press-mounting of the retardant ring onto the ledge upon assembly of the lipstick, the radial prestress resulting from resilient circumferential stretching of the retardant ring along an entire circumference of the retardant ring.

* * * * *